US006264552B1

(12) United States Patent
Oya et al.

(10) Patent No.: US 6,264,552 B1
(45) Date of Patent: Jul. 24, 2001

(54) CEILING-EMBEDDED AIR CONDITIONER

(75) Inventors: Ryo Oya; Tatsuo Sone; Hiroshi Nakashima; Atsushi Edayoshi; Kazunobu Sekiguchi; Manabu Asahina, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/615,804

(22) Filed: Jul. 13, 2000

(51) Int. Cl.[7] ..... F24F 13/06
(52) U.S. Cl. ..... 454/304; 454/313; 454/318
(58) Field of Search ..... 454/259, 299, 454/300, 304, 313, 318, 322, 333

(56) References Cited

U.S. PATENT DOCUMENTS

| | | | | |
|---|---|---|---|---|
| 4,823,679 | | 4/1989 | Robbins | 454/259 X |
| 5,058,492 | * | 10/1991 | Norton | 454/259 |
| 5,236,391 | | 8/1993 | Schaefer | 454/259 X |
| 5,577,958 | * | 11/1996 | Kumekawa et al. | 454/304 X |

FOREIGN PATENT DOCUMENTS

| | | | |
|---|---|---|---|
| 2 338 940 | | 8/1973 | (DE) . |
| 0 439 736 | | 8/1991 | (EP) . |
| 1 514 459 | | 6/1978 | (GB) . |
| 2129119 | * | 5/1984 | (GB) . |
| 1-217141 | | 8/1989 | (JP) . |
| 4-032444 | | 3/1992 | (JP) . |
| 4-324053 | | 11/1992 | (JP) . |
| 5-1126387 | | 5/1993 | (JP) . |
| 6-032952 | | 4/1994 | (JP) . |

* cited by examiner

*Primary Examiner*—Harold Joyce
(74) *Attorney, Agent, or Firm*—Oblon, Spivak, McClelland, Maier & Neustadt, P.C.

(57) ABSTRACT

A ceiling-embedded air conditioner including a decorative panel having: a plurality of air blow openings, an air blow shutdown member for shutting down an internal air passage of unused air blow opening(s) of said air blow openings, and vanes provided in the internal air passage of said air blow openings for changing an air direction, wherein a mount position of said vanes is in the vicinity of a surface of said decorative panel in said internal air passage, and unused air blow opening(s) of said air blow openings can be fully closed by said vanes.

4 Claims, 3 Drawing Sheets

CEILING-EMBEDDED AIR CONDITIONER

BACKGROUND OF THE INVENTION

1. Field of the Invention

The present invention relates to a room air conditioner having a plurality of air blow openings and vanes disposed in each air blow opening as air direction control means.

2. Prior Art

FIG. 5 is a sectional view showing an air blow opening of a room air conditioner being a conventional ceiling-embedded air condition. In the drawing, reference numeral 1 denotes a decorative panel fixed to a room air conditioner main body; reference numeral 1*a* denotes an air blow opening for blowing out an air conditioned by a heat exchanger of a freezing cycle (not shown) inside of the main body; reference numeral 1*b* denotes an internal air passage in the decorative panel 1; reference numeral 2 denotes a respective one of vanes arranged at each air blow opening 1*a*; reference numeral 2*a* denotes a vane rotary shaft of the vane 2 which controls an air blow direction; reference numeral 3 denotes an air blow shutdown member mounted when the member is installed at an air blow opening 1*a* which is not used.

In the air blow opening 1*a* to which an air blow shutdown member 3 is mounted, an air is not blown out from the air blow opening 1*a*, but the unused air blow opening is the same as a used air blow opening 1*a* not having an air blow shutdown member in other respects. The air blow shutdown member 3 is hardly seen from a user because the member is positioned at the depth of an internal air passage 1*b*.

A room air conditioner which is a conventional ceiling-embedded air conditioner is configured as described above. With such configuration, in the case where any of plural air blow openings 1*a* is not used, the air is merely shut down by an air blow shutdown member 3 provided at the depth of the internal air blow passage 1*b*. Except that, an unused air blow opening is not different from a used air blow opening. Therefore, there has been a problem that it is difficult for a user to discriminate whether or not the air blow opening is used.

SUMMARY OF THE INVENTION

The present invention has been made in order to solve such problem. It is an object of the present invention to provide a ceiling-embedded air conditioner capable of easily discriminating whether or not the air blow opening is used from the appearance of a decorative panel.

It is another object of the present invention to provide a ceiling-embedded air conditioner capable of easily discriminating whether or not the air blow opening is used, adjusting an air direction every air blow opening, and improving amenity from the viewpoints of human and material engineering.

A ceiling-embedded air conditioner of the present invention includes a decorative panel having: a plurality of air blow openings, an air blow shutdown member for shutting down an internal air passage of unused air blow opening(s) of the air blow openings, and vanes provided in the internal air passage of the air blow openings for changing an air direction, wherein a mount position of the vanes is in the vicinity of a surface of the decorative panel in the internal air passage, and unused air blow opening(s) of the air blow openings can be fully closed by the vane(s). Thus, it can be easily discriminated whether or not the air blow opening is used from the appearance.

Furthermore, all of the air blow openings are fully closed by the vanes when the air conditioner stops. Therefore, it is possible to easily discriminate operation of the air conditioner from the appearance.

Furthermore, a vane driving motor for driving a respective one of the vanes is provided in the decorative panel, whereby the air direction can be adjusted every air blow opening, and amenity is improved from the viewpoints of human and material engineering.

Furthermore, a resisting member for fixing the vane at an arbitrary position in its movable region is disposed between a vane bearing and a vane rotary shaft pivoted by the vane bearing provided at the decorative panel. For this configuration, an air direction can be adjusted every air blow opening, and amenity is improved from the viewpoints of human and material engineering.

BEST MODE FOR CARRYING OUT THE INVENTION

First Embodiment

Hereinafter, a first embodiment of the present invention will be described with reference to the accompanying drawings.

Figure 1:
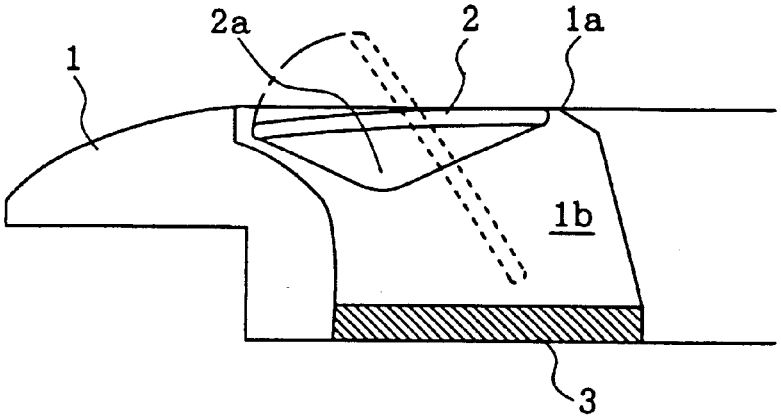
FIG. 1 is a sectional view showing an air blow opening of a room air conditioner being a ceiling-embedded air conditioner according to a first embodiment of the present invention.

FIG. 1 is a sectional view showing an air blow opening of a room air conditioner according to a first embodiment. In the drawing, reference numeral 1 denotes a decorative panel fixed to a room air conditioner main body; reference numeral 1*a* denotes each air blow opening for blowing out an air conditioned by a heat exchanger of a freezing cycle (not shown) inside of the main body; reference numeral 1*b* denotes an internal air passage in the decorative panel 1; reference numeral 2 denotes a respective one of vanes arranged at each air blow opening 1*a*; reference numeral 2*a* denotes a vane rotary shaft which controls an air blow direction; reference numeral 3 denotes an air blow shutdown member mounted when the member is installed at an air blow opening 1*a* which is not used.

In the ceiling-embedded air conditioner according to the first embodiment, the mount position of the vane 2 is moved to the vicinity of a surface of a decorative panel 1 in an internal air passage 1*b* as shown in FIG. 1. This makes it possible to fully close an unused air blow opening 1*a* by the vane 2 when any of the plurality of air blow openings 1*a* is not used in the ceiling-embedded air conditioner having a plurality of air blow openings 1*a*.

Accordingly, when any of the air blow openings 1*a* is not used, the air blow to the unused air blow opening is internally shut down by means of the air blow shutdown member 3, and the unused air blow opening 1*a* is fully closed by the vane 2.

Therefore, it is possible to easily discriminate whether or not the air blow opening 1*a* is used from the appearance.

In addition, during stoppage of the air conditioner as well, all the air blow openings 1*a* are fully closed by vanes 2, thereby making it possible easily discriminate operation of the air conditioner from the appearance.

Second Embodiment

In a second embodiment, as shown below, in addition to the configuration of the first embodiment, a vane driving motor for driving the vane of each air blow opening is provided so that the air direction can be adjusted every air blow opening.

Hereinafter, the second embodiment of the present invention will be described with reference to the accompanying drawings.

Figure 2:
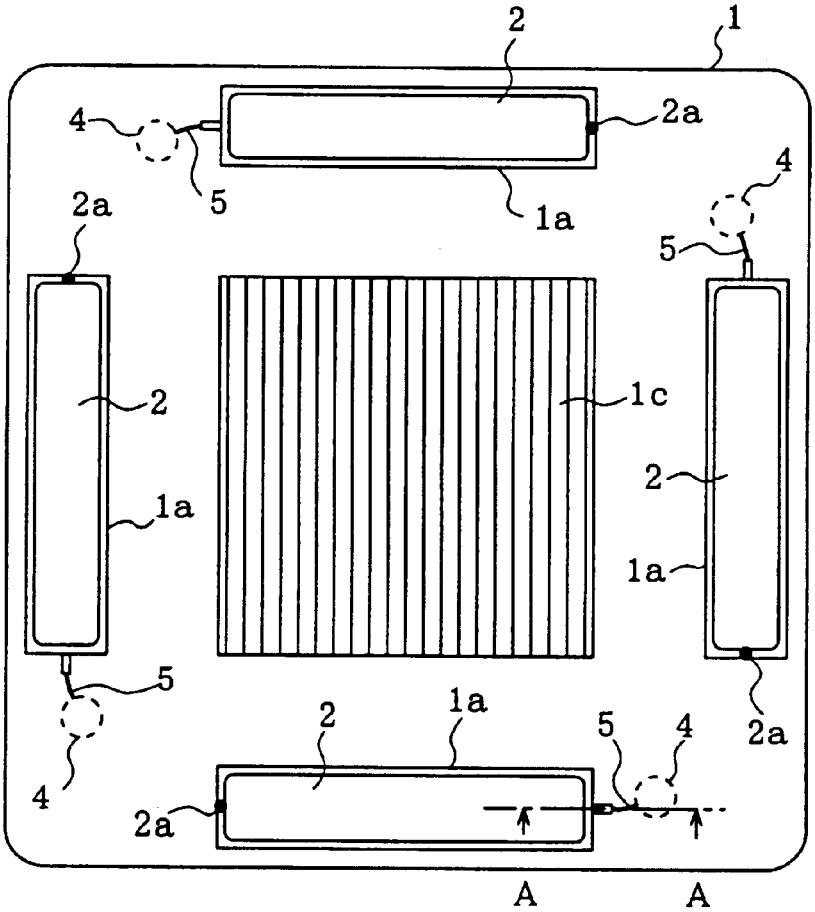
FIG. 2 is a conceptual view of the room air conditioner which is the ceiling-embedded air conditioner according to a second embodiment.
Figure 3:
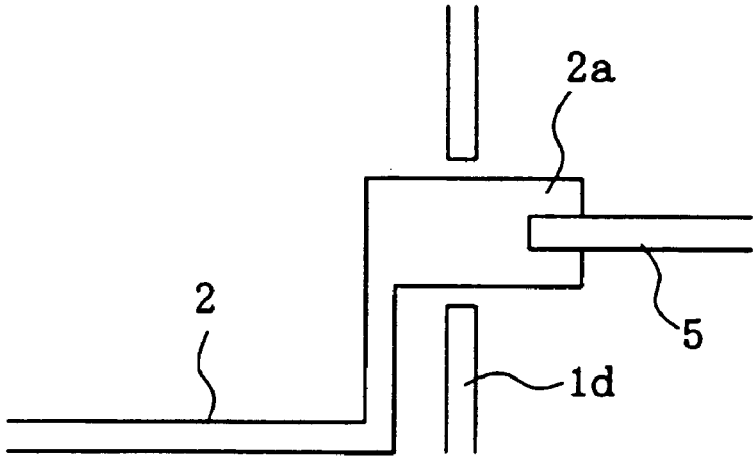
FIG. 3 is a sectional view taken along a line A—A of FIG. 2.

FIG. 2 is a conceptual view showing an air blow opening of a room air conditioner being a ceiling-embedded air conditioner according to the second embodiment of the present invention. FIG. 3 is a sectional view taken along a line A—A of FIG. 2. In the drawings, reference numeral 1 denotes a decorative panel fixed to the room air conditioner main body, wherein air is taken from a suction opening 1*c*, the air passes through an internal air passage 1*b* of a decorative panel 1, and the air is exhausted from an air blow opening 1*a*; reference numeral 2 denotes a respective one of vanes arranged at each air blow opening 1*a*; reference numeral 4 denotes a vane driving motor for driving a vane 2 incorporated in the decorative panel 1; reference numeral 5 denotes a link member for linking the respective vane 2 with the vane driving motor 4, wherein the vane 2 is driven by the vane driving motor 4 based on the control from the main body; and reference numeral 1*d* denotes a vane bearing which pivots a vane rotary shaft 2*a* linked with the link member 5.

In the ceiling-embedded air conditioner according to the second embodiment, in addition to an advantageous effect of the first embodiment, a respective one of the driving motors 4 is linked with each vane 2 via the link member 5, whereby the air direction can be controlled by each vane 2, and conformation air conditioning is ensured from the viewpoints of human and material engineering.

Third Embodiment

In a third embodiment, in addition to the configuration of the first embodiment, as shown below, a vane link member connected to the vane driving motor is removed from each vane, and a resisting member for fixing the vane at an arbitrary position in its movable region is provided at a vane bearing, so that an air direction can be adjusted every air blow opening.

Hereinafter, the third embodiment of the present invention will be described with reference to the third embodiment.

Figure 4:
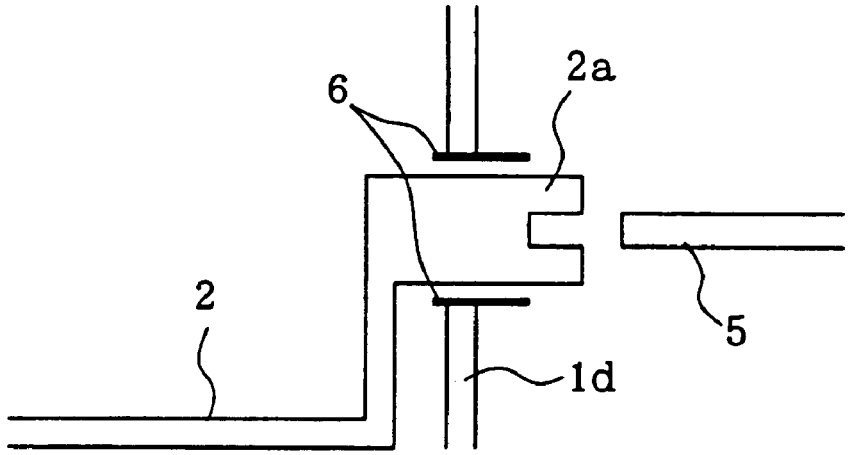
FIG. 4 is a sectional view showing the vicinity of a vane bearing according to the third embodiment.
Figure 5:
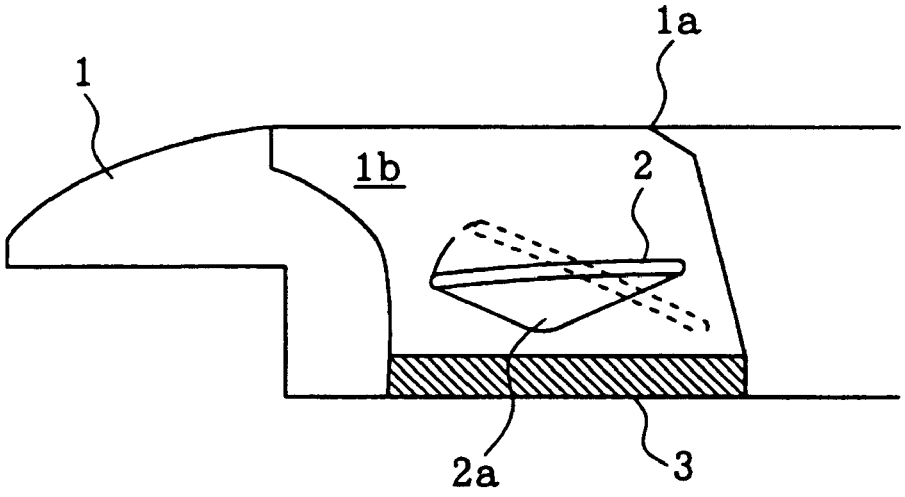
FIG. 5 is a sectional view showing an air blow opening of a room air conditioner which is a conventional ceiling-embedded air conditioner.

FIG. 4 is a sectional view showing the vicinity of the vane bearing according to the third embodiment. In the drawing, reference numeral 1*d* denotes a vane bearing arranged at the decorative panel 1; reference numeral 2 denotes a respective one of vanes arranged at each air blow opening 1*a*; reference numeral 2*a* denotes a vane rotary shaft; reference numeral 5 denotes a link member for linking the vane 2 with the vane driving motor 4; reference numeral 6 denotes a resisting member provided between the vane bearing 1*d* and the vane rotary shaft 2*a* for fixing the vane 2 at an arbitrary position in its movable region.

In the ceiling-embedded air conditioner according to the third embodiment, in addition to an advantageous effect of the first embodiment, a vane link member connected to the vane driving motor 3 is removed from each vane 2, and the resisting member 6 is mounted. For this configuration, the user can fix the vane at an arbitrary position in its movable region. Thus, individual air direction control is made possible, and conformable air conditioning is ensured from the viewpoint of human and material engineering.

We claim:

1. A ceiling-embedded air conditioner including a decorative panel having:

a plurality of air blow openings, an air blow shutdown member for shutting down an internal air passage of unused air blow opening(s) of said air blow openings, and vanes provided in the internal air passage of said air blow openings for changing an air direction, wherein a mount position of said vanes is in the vicinity of a surface of said decorative panel in said internal air passage, and unused air blow opening(s) of said air blow openings can be fully closed by said vane(s).

2. The ceiling-embedded air conditioner as set forth in claim 1, wherein all of said air blow openings are fully closed by said vanes when said air conditioner stops.

3. The ceiling-embedded air conditioner as set forth in claim 1, wherein a vane driving motor for driving a respective one of said vanes is provided in said decorative panel.

4. The ceiling-embedded air conditioner as set forth in claim 1, wherein a resisting member for fixing said vane at an arbitrary position in its movable region is disposed between a vane bearing and a vane rotary shaft pivoted by said vane bearing provided at said decorative panel.

* * * * *